US007010901B2

(12) United States Patent
Ogura et al.

(10) Patent No.: US 7,010,901 B2
(45) Date of Patent: Mar. 14, 2006

(54) ADHESIVE SOLID HAVING ANTI-MUTUAL ADHESION, METHOD OF PRODUCING THE SAME AND METHOD OF PACKAGING THE SAME

(75) Inventors: Kazuhiro Ogura, Ako (JP); Yoshio Yoshikawa, Ako (JP)

(73) Assignee: Matsumura Oil Research Corp., Kobe (JP)

( * ) Notice: Subject to any disclaimer, the term of this patent is extended or adjusted under 35 U.S.C. 154(b) by 0 days.

(21) Appl. No.: 10/463,864

(22) Filed: Jun. 18, 2003

(65) Prior Publication Data

US 2004/0255555 A1 Dec. 23, 2004

(51) Int. Cl.
*B65B 29/00* (2006.01)

(52) U.S. Cl. ..... 53/402; 53/467; 53/428; 53/433; 264/334

(58) Field of Classification Search ..... 53/402, 53/428, 433, 467; 264/299, 300, 319, 325, 264/334
See application file for complete search history.

(56) References Cited

U.S. PATENT DOCUMENTS

| | | | | |
|---|---|---|---|---|
| 4,306,657 | A * | 12/1981 | Levy | 206/447 |
| 4,748,796 | A * | 6/1988 | Viel | 53/411 |
| 4,755,245 | A | 7/1988 | Viel | 156/227 |
| 5,715,654 | A * | 2/1998 | Taylor et al. | 53/440 |
| 6,006,497 | A * | 12/1999 | Waver et al. | 53/440 |
| 6,155,029 | A * | 12/2000 | Jain | 53/440 |
| 6,230,890 | B1 * | 5/2001 | Waver et al. | 206/447 |

FOREIGN PATENT DOCUMENTS

| | | |
|---|---|---|
| JP | 03-047887 | 2/1991 |
| WO | WO 92/02348 | 2/1992 |

* cited by examiner

*Primary Examiner*—Louis K. Huynh
*Assistant Examiner*—Brian Nash
(74) *Attorney, Agent, or Firm*—Kubovcik & Kubovcik

(57) ABSTRACT

A method of producing a hot melt adhesive solid, the method comprising the steps of inserting a hot melt adhesive heated to higher than a flow temperature into a container having a mold-releasing internal surface and a bottom plate which is openable and closable or removably fixable to the container, cooling the hot melt adhesive at least until the surface of hot melt adhesive becomes solidified, and taking out the hot melt adhesive from the container by opening the bottom plate or displacing the same; hot melt adhesive solid; method of packaging the same; and method of transporting the same.

2 Claims, 1 Drawing Sheet

ADHESIVE SOLID HAVING ANTI-MUTUAL ADHESION, METHOD OF PRODUCING THE SAME AND METHOD OF PACKAGING THE SAME

TECHNICAL FIELD

The present invention relates to a method of producing a hot melt adhesive solid having a property of inhibiting solid blocks from adhering to each other (hereinafter referred to as "anti-mutual adhesion"), the produced hot melt adhesive solid and methods of packaging and transporting a hot melt adhesive.

BACKGROUND ART

Generally a hot melt adhesive to be applied in a thermally fluid state takes a solid form at room temperature. The hot melt adhesive is generally provided in the form of a block and is heated to become melted before use. Because of such properties, the hot melt adhesive poses various problems in handling and packaging. The block of hot melt adhesive solid not only sticks or adheres to our hands or mechanical handling devices but also combines our hands or mechanical handling devices with each other. Further the block picks up dirt and contaminants. In addition, a hot melt adhesive having an adhesive surface is used as accommodated in a paper container or a plastic container which is made mold-releasing with silicone or the like to avoid mutual adhesion and to improve operational efficiency.

However, such packaging method requires removal and disposal of packaging materials in using the packaged hot melt adhesive. That is, the method involves labor and is likely to contaminate the environment with waste.

From viewpoints of saving of resources and environmental conservation, methods have been carried out which comprise wrapping the hot melt adhesive with a polyolefin film instead of using such container and melting the wrapped without removing the polyolefin film. However, these methods have caused troubles. Since the polyolefin film has a relatively high softening point, it takes a long time to uniformly dissolve the polyolefin film in molten hot melt adhesive composition. Due to properties of polyolefin, properties of hot melt adhesive are impaired and heat stability in a tank of hot melt adhesive is lowered. Another method was proposed wherein wax or the like is sprayed over the inside of a metal container and a hot melt adhesive is filled into the wax-coated metal container, thereby eliminating the adhesion from the surface of the adhesive. However, the side of the metal container is coated with a lesser amount of wax than the wax applied to the bottom of the metal container. That is, the wax is deposited on the bottom and on the side of the metal container at an irregular ratio. Furthermore, the hot melt adhesive is handled in a high temperature environment wherein the adhesive is flowable, so that the molten wax is dissolved and penetrated into the hot melt adhesive. Namely, the adhesive is readily affected by the temperature, and incorporates an increased amount of adhesion inhibitor.

To overcome these problems, it is necessary to minimize the ratio of an adhesion inhibitor such as wax by coating the largest possible hot melt adhesive block with the adhesion inhibitor and by applying a film over portions of blocks to be contacted with each other to completely separate the adhesive blocks from each other. More specifically, a method is being investigated wherein wax is sprayed over a tray having a shape such as cylinder and rectangular parallelepiped and a hot melt adhesive is filled thereinto and molded. However, if the wax is applied in a lesser amount, it is difficult to separate the tray from the hot melt adhesive. On the other hand, this method has a drawback. A large amount of wax sprayed facilitates separation of the tray from the adhesive but may be mingled with the adhesive, thereby affecting properties of the adhesive.

A further method was proposed wherein a hot melt adhesive is continuously forced out from an extrusion molding machine and is cut to a proper length to mold pellets, followed by coating the pellets with wax. However, the hot melt adhesive to be produced by this method is limited to relatively small size blocks. To produce large size hot melt adhesive blocks, a large scale extrusion molding machine is required, and a high equipment cost is incurred. Namely the method is improper for commercial manufacture.

Objects of the present invention are to provide a hot melt adhesive solid and a method of producing the hot melt adhesive solid, the method being capable of overcoming the foregoing problems of conventional packaging methods which can prevent the adhesion of hot melt adhesive blocks to each other, the method being capable of minimizing the proportion of a different material such as a film mingling with the hot melt adhesive, preventing the hot melt adhesive blocks from adhering to each other and achieving a high operational efficiency, and to provide methods of packaging and transporting hot melt adhesive blocks wherein the amount of waste derived from packaging materials can be suppressed.

DISCLOSURE OF THE INVENTION

Figure 1:
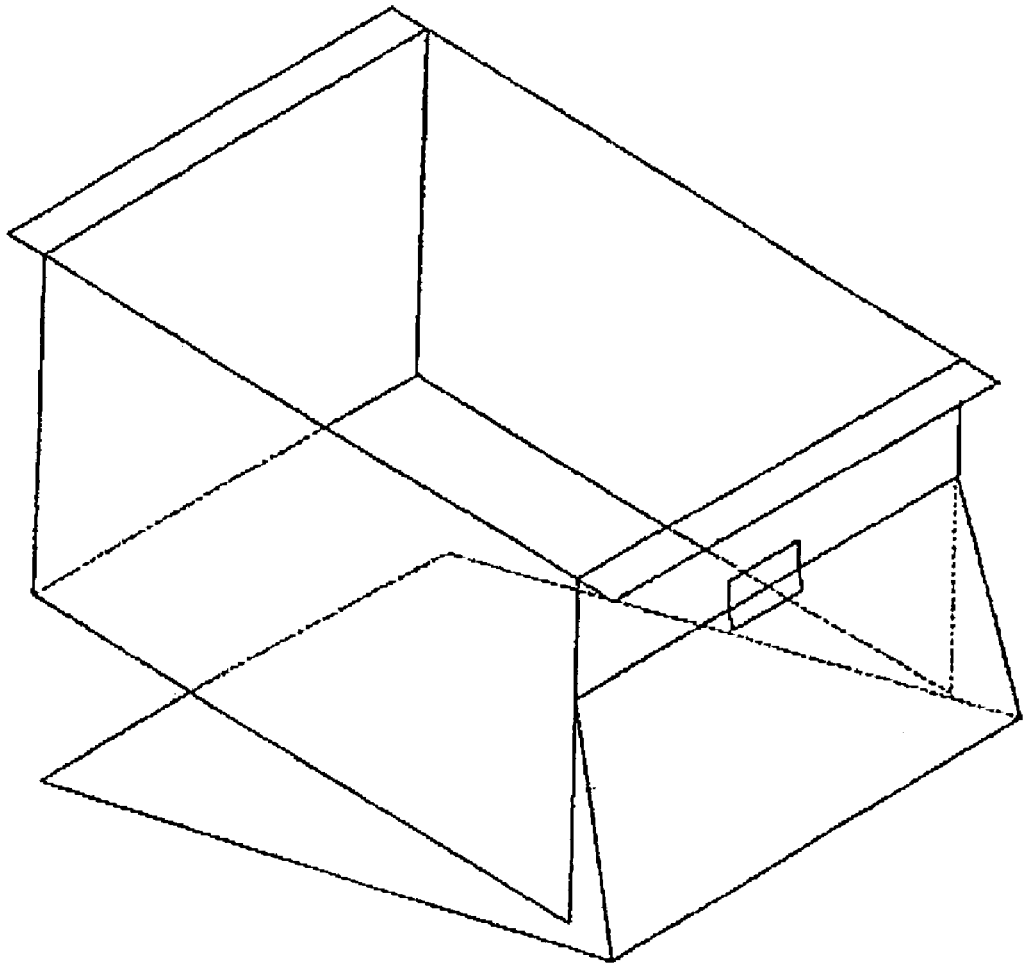
FIG. 1 shows an open top container for forming a hot melt adhesive.

The present invention provides a method of producing a hot melt adhesive solid, the method comprising the steps of inserting a hot melt adhesive heated to higher than a flow temperature into a container having a mold-releasing internal surface and a bottom plate which is openable and closable or removably fixable to the container (hereinafter abbreviated to a "block molding container"), cooling the hot melt adhesive at least until the surface of hot melt adhesive becomes solidified, and taking out the hot melt adhesive solid from the container by opening the bottom plate or displacing the same.

The invention further provides a method of producing a hot melt adhesive solid having an anti-mutual adhesion, characterized in that the hot melt adhesive solid produced by the foregoing producing method is coated with an anti-mutual adhesion powder. The invention also provides a hot melt adhesive solid having an anti-mutual adhesion, wherein a major surface portion of the adhesive solid produced by the producing method is coated with an anti-mutual adhesion powder.

The invention also provides a method of packaging and transporting a hot melt adhesive solid, the method comprising filling and transporting the hot melt adhesive solid in a container which is durable in terms of transport sufficiently to reciprocatingly carry the solid a plurality of times between the place of production and the place of use.

The applicant of the present invention filed a patent application under Application No.2001-205052 relating to a similar hot melt adhesive solid wherein the hot melt adhesive placed in the container is taken out from the container by contact of the container with hot water after cooling the surface of the hot melt adhesive in the container. On the other hand, the present invention is directed to a method wherein a hot melt adhesive is taken out from the container by opening the bottom plate of the container or displacing the bottom plate instead of contact of the container with hot water as done in the prior application.

The block molding container having a mold-releasing property which is used in the invention is a container in which the hot melt adhesive does not firmly adhere to the internal surface of the container. More specifically the container is lined with a film or a sheet made of, e.g., fluorine resin, silicone resin or polypropylene although not limited thereto. Optionally, other desired means can be used insofar as the internal surface of the container is made mold-releasing. Among them, a sheet of silicone rubber is preferable to use. The entire internal surface need not be mold-releasing. The internal surface should have a mold-releasing property sufficient at least to allow the withdrawal of hot melt adhesive (hereinafter abbreviated to "HMA") from the container.

More preferred is a sheet made of any of the above-mentioned materials which is embossed (processed to give an uneven surface) because HMA is easily separated from the internal surface of the container and withdrawal is facilitated.

The shape of the block molding container to be used in the invention can be selected from shapes such as top-opened box shape, cylindrical shape and polygonal column shape which comply with the shape of the desired HMA solid. The bottom portion of the container is openable or closable by hinges or removably fixed. When the container is in the shape of a box, the side portion is preferably openable or closable. The material for the container is preferably a metal of high heat conductivity which easily and efficiently cools molten HMA, although not limited thereto. Examples of such metals are iron, stainless steel, copper, aluminum, aluminum alloy and titanium alloy. Among them, aluminum or aluminum alloy is preferred because they are high in heat conductivity, lightweight and relatively low in costs.

A block of adhesive composed of only pure components can be prepared by use of such a block molding container which is made mold-releasing. The container can be repeatedly used and generates no waste.

Examples of the HMA to be used in the invention include adhesives made of synthetic resins, synthetic rubber, plasticizers, petroleum substances, natural resins and fillers.

HMA is heated to a temperature higher than the softening point and is filled into the container by an extrusion pump or the like. The molten HMA in the container is cooled at least until the surface of HMA becomes solidified. The HMA may be cooled by contact of the container with a coolant or with cooled air, but usually is cooled by natural cooling at room temperature. The solidified HMA is easily dropped due to its own weight by opening the bottom portion of the container or by slightly pressing the upper surface of solidified HMA. In this operation, when the container is of the type whose side portion is openable or closable, the container can be simultaneously opened in the side portion and the HMA solid is more easily dropped. Hence this type is preferred. In this way the HMA solid is molded in the predetermined shape.

Subsequently an anti-mutual adhesion powder is applied to the surface of HMA solid so that an anti-mutual adhesion layer is formed on the uppermost surface of the HMA solid. Examples of the anti-mutual adhesion powder are wax, clay, talc, mica, magnesium carbonate, calcium carbonate and like inorganic powders, EVA and like organic powders. Among them, wax powder is preferable because it can give a sufficient anti-mutual adhesion when applied in an amount in which the properties of HMA are not impaired. Examples of the wax powder are not limited and include paraffin, microcrystalline wax and like petroleum wax, polyethylene wax, Fischer-Tropsch wax and like synthetic wax. To minimize the influence on the properties of adhesive, preferred wax is a wax powder having a particle size of about 10 $\mu$m or less, preferably about 3 to about 10 $\mu$m and a melting point of 80 to 120° C.

The powder can be applied by sprinkling over the entire surface of the HMA solid. The larger the amount of powder applied is, the more effectively the HMA solids are prevented from adhesion to each other. Nevertheless, this is uneconomical and is likely to affect properties of HMA itself. Thus, in order to lower the content of the adhesion inhibitor relative to the HMA to the highest possible extent and to uniformly distribute the powder over the surface of HMA solid, the coated surface may be preferably scraped with cloth, sponge, roller or the like after application of wax for removing the excess powder so as to leave the required minimum amount of wax powder. Optionally the excess wax can be removed by washing the surface of adhesive solid with warm or hot water. Other methods include a method wherein the powder is sprayed over the surface of HMA by use of a spray nozzle or like devices, and a method wherein the powder is dispersed in water and is sprayed. In any of these methods, the powder can be uniformly applied to the entire surface of HMA solid.

Further, when the surface of HMA solid becomes to a low temperature and a sufficient amount of wax or like powder can not be applied thereto, it is preferable to heat only the surface of HMA sold by use of a heater or the like before applying wax or like powder. It is possible to afford adhesiveness to the surface of HMA solid and to apply a sufficient amount of wax or like powder to the surface of HMA solid, by the above heating.

When such methods are performed, the amount of powder to be applied to the HMA solid can be easily controlled and the deterioration of properties of HMA solid can be suppressed to the greatest extent. According to the method of the invention, the amount of adhesion inhibitive powder can be reduced to the required minimum level. It is possible to prevent the mutual adhesion of HMA with practically no damage to the properties of HMA for use.

When wax powder is used, the amount of wax powder to be applied is preferably about 0.01 to about 0.1 wt %, more preferably about 0.03 to about 0.05 wt %, based on the total amount of HMA solid. When the wax powder is applied in this range of amount, sufficient anti-mutual adhesion can be imparted and the deterioration of properties of HMA itself is substantially negligible.

In this way, there can be obtained an anti-mutual adhesion HMA solid having a major portion of the surface coated with wax powder.

The anti-mutual adhesion HMA solid produced as described above can be packaged in a conventional container such as a corrugated cardboard box and can be carried therein. To reduce the possibility of the container being disposed of as waste, it is preferable to fill and carry the solid in a container (hereinafter referred to as "carrier box") which is durable in terms of transport sufficiently to reciprocatingly carry the solid a plurality of times between the place of production and the place of use. The carrier box has generally a box shape and is made of substantially unlimited materials, including plastics and metals. Among them, plastics are preferred since a carrier box made of plastics has satisfactory strength and durability and are relatively lightweight.

As described above, containers made of, e.g., plastics are used as a carrier box, among which folding containers are desirable because they incur lower transport costs. Various types of folding containers are commercially available and a suitable one can be selected according to the size and number of HMA solid blocks to be filled therein.

Thus, the HMA solid is filled into a carrier box and is packaged, stored and transported therein. After the HMA solid in the carrier box is used by the user, the carrier box is re-used without giving rise to waste derived from packaging/transporting containers and packaging materials.

BRIEF DESCRIPTION OF THE DRAWING

FIG. 1 is a perspective view schematically showing an example of a block molding container.

BEST MODE OF CARRYING OUT THE INVENTION

The present invention will be described in more detail with reference to the following Examples to which, however, the invention is not limited.

EXAMPLE 1

A silicone sheet was fixed to an internal side surface and an internal bottom surface of a block molding container internally measuring 150 mm×200 mm×100 mm (height). 2.5 kg of a hot melt adhesive which became flowable at 150° C. was filled into the container with a bottom plate which was openable by means of hinges. The hot melt adhesive was completely solidified when left to cool. Then, a cylindrical rod 40 mm in diameter was directly thrusted downward at an upper surface of the hot melt adhesive to impose a load of 40 kgf while the bottom plate was retained in an opened state. Then, the hot melt adhesive was readily pushed out and dropped.

EXAMPLE 2

Synthetic paraffin wax 5 to 7 $\mu$m in particle size was sprinkled over the hot melt adhesive prepared in Example 1, and the wax-sprinkled surface was scraped with a cloth piece to remove the excess wax and to uniformly spread the wax powder over the surface, whereby a hot melt adhesive solid having an anti-mutual adhesion surface was produced. The amount of synthetic paraffin wax fixed to the solid was measured in terms of weight, and was 0.05 wt % based on the total weight of the solid.

EXAMPLE 3

The hot melt adhesives prepared in Examples 1 and 2 were tested for viscosity according to JIS K 6862, B method, for softening point according to JIS K 6863, and for 180-degree peel strength according to JIS Z 0237. The results are shown in Table 1.

TABLE 1

| | Ex.1 | Ex.2 |
|---|---|---|
| viscosity (mPa · s/at 160° C.) | 4150 | 4100 |
| softening point (° C.) | 100 | 100 |
| 180-degree peel strength (N/10 mm) | 17.0 | 17.5 |

The results show that the hot melt adhesive coated with synthetic paraffin wax was substantially identical in viscosity, softening point and 180-degree peel strength with the uncoated hot melt adhesive. This indicates that 0.05 wt % of wax does not affect properties of hot melt adhesive at all.

EXAMPLE 4 (Transport Test)

Eight blocks of the hot melt adhesive solid prepared in Example 2 were placed into a folding container made of plastic measuring 401 mm (width), 299 mm (length) and 212 mm (height) (manufactured by Sanko Co., Ltd. lot No.25B), and were transported by a truck over a distance of about 200 km. The temperature of outside air was about 30° C. during transport. The hot melt adhesive solid after transport was tested for properties. The blocks of hot melt adhesive solid were easily taken out from the container without blocks adhering to each other. The adhesive blocks did not stick to operator's hand or clothes during handling.

INDUSTRIAL APPLICABILITY

According to the invention, a hot melt adhesive can be easily separated from the container without applying excessive outer force by imparting a mold-releasing property to the inside of the container and using the container having a bottom plate which is openable and closable. The product of the invention can reduce the content of adhesion inhibitive material such as films so that in a design of a product, the production of a product having extraordinary properties can be averted. The product of the invention can be immersed as it is, in a tank of melt, whereby handling is facilitated. The generation of waste can be avoided by use of plastic packages or transporting containers made of plastics. Thus the invention provides excellent packaging product.

The invention claimed is:

1. A method of producing a hot melt adhesive solid, the method comprising the steps of inserting a hot melt adhesive heated to higher than a flow temperature into a container having an open top, a mold-releasing internal surface and a bottom surface formed by a bottom plate which is openable and closable or removably fixable to the container, cooling the hot melt adhesive at least until the surface of hot melt adhesive becomes solidified, forming an opening in the container opposite the open top by opening the bottom plate or displacing the same, and taking out the hot melt adhesive from the container through the opening formed in the container opposite the open top.

2. A method of producing a hot melt adhesive solid according to claim 1, wherein the surface of the hot melt adhesive solid is coated with an anti-mutual adhesion powder.

* * * * *